US005746661A

United States Patent [19]

Murphy

[11] Patent Number: 5,746,661

[45] Date of Patent: May 5, 1998

[54] GOLF PUTTER WITH OFFSET GRIP SHAFT

[76] Inventor: James Murphy, P.O. Box 412, Accord, Mass. 02018

[21] Appl. No.: 642,508

[22] Filed: May 3, 1996

[51] Int. Cl.[6] ..... A63B 53/14

[52] U.S. Cl. ..... 473/204; 473/409; 473/294

[58] Field of Search ..... 473/201, 202, 473/203, 204, 206, 300, 301, 302, 303, 288, 289, 313, 314, 251, 219, 226, 409, 294

[56] References Cited

U.S. PATENT DOCUMENTS

| | | | |
|---|---|---|---|
| D. 202,504 | 10/1965 | Citro | D34/5 |
| D. 204,002 | 3/1966 | Tanis et al. | D34/5 |
| D. 213,838 | 4/1969 | McAllister | D21/3 |
| D. 255,592 | 6/1980 | Krysakowski | D21/218 |
| D. 256,824 | 9/1980 | Ward et al. | D21/217 |
| D. 326,302 | 5/1992 | Guerin, Sr. | D21/217 |
| 1,201,728 | 10/1916 | Henry et al. . | |
| 1,979,174 | 10/1934 | Robertson | 273/81 |
| 2,132,219 | 10/1938 | Pirie | 273/81 |
| 2,212,651 | 8/1940 | Sanderson | 273/77 |
| 2,298,505 | 10/1942 | Ottman | 473/203 |
| 3,062,549 | 11/1962 | Duden | 273/81.3 |
| 3,341,203 | 9/1967 | Brill | 273/81.3 |
| 3,663,019 | 5/1972 | Palotsee | 202/273 |
| 4,269,412 | 5/1981 | Hughes | 271/81.3 |
| 4,621,816 | 11/1986 | Leek | 273/168 |
| 4,625,965 | 12/1986 | Mullins | 273/81.3 |
| 4,795,153 | 1/1989 | Thomas | 273/81.3 |
| 4,852,877 | 8/1989 | Scalf | 273/77 |
| 5,125,130 | 6/1992 | Stanish | 16/110 |
| 5,127,650 | 7/1992 | Schneller | 273/81 |
| 5,374,064 | 12/1994 | Barber | 273/194 |
| 5,454,564 | 10/1995 | Kronogard | 473/300 |

FOREIGN PATENT DOCUMENTS

| | | | |
|---|---|---|---|
| 2006025 | 5/1979 | United Kingdom | 273/81.3 |
| 2253152 | 9/1992 | United Kingdom | 273/81 R |

*Primary Examiner*—Sebastiano Passaniti
*Attorney, Agent, or Firm*—Ernest V. Linek

[57] ABSTRACT

Disclosed is a putter called the "HOLN-1™" that has an offset handle that was made by having a standard putter handle putting the offset in it. The present putter allows the golfer to putt the ball with a smooth pendulum like stroke taking the unwanted "wristing" action out of your stroke translating in less pulled putts and more birdies and pars. Testing of this invention with golfers has found acceptance with all who have tried it, particularly with the "feel" provided when striking the ball. The shaft of this invention forces the golfer to put one hand under the other, creating the ideal triangle between arms, shoulders and hands. Such a triangle is needed to make smooth putts. The shaft of the present invention can be used as a training aid or actually used right on the course for instant results.

6 Claims, 1 Drawing Sheet

GOLF PUTTER WITH OFFSET GRIP SHAFT

FIELD OF THE INVENTION

This invention relates to the field of golf, and has reference more particularly to a modification of the putter shaft for the purpose of guiding the movement of the latter while it is being used to strike a golf ball, insuring that the club head of the putter will move in a straight and true manner.

BACKGROUND OF THE INVENTION

Training devices for golf are abundant in the prior art. See for example the following references, the disclosures of which are hereby incorporated herein by reference:

U.S. Pat. No. 5,374,064 to Barber, entitled Golf Club Training Apparatus, describes a new and improved golf club training apparatus which includes a head assembly with a planar, ball-hitting surface. The planar, ball-hitting surface lies in a first plane and a shaft assembly is connected to the head assembly. The head assembly and the shaft assembly are oriented with respect to each other along a first longitudinal axis, and a first handle grip assembly is connected to the shaft assembly. The first handle grip assembly includes a first handle portion connected to the shaft assembly along the first longitudinal axis. The first handle grip assembly also includes a second handle portion connected to the first handle portion at a acute angle of approximately thirty degrees with respect to the first longitudinal axis passing through the first handle portion.

U.S. Pat. No. 5,127,650 to Schneller, entitled Golf Putter And Method For Putting, describes an improved pendulum golf putter. The putter has an elongated shaft having upper and lower portions. The putter head fixedly mounted to the end of the lower portion of the shaft. A grip is provided having an upper portion and a lower portion, said grip being fixed to the upper portion of the shaft.

U.S. Pat. No. 5,125,130 to Stanish, entitled Ergonomic Handle For Tools And Sporting Equipment, describes an ergonomic handle for tools and sporting equipment which comprises an elongated member equipped with a two-membered gripping portion at one end whose two members are disposed at compound angles from the longitudinal axis of the elongated member. These angles are said to correspond to the natural angles of hand, wrist, and forearm in a pointing posture.

U.S. Pat. No. 4,852,877 to Scalf, entitled Golf Putter, describes a golf putter with a putter head member having a vertical impact face and an elongated shaft member angularly disposed in an offset relationship in two distinct planes relative to the flat rear surface of the putter head member.

U.S. Pat. No. 4,795,153 to Thomas, entitled Golf Club, describes a putter which includes a club head, a handle portion and a shaft structure interconnecting the club head and the handle portion. The shaft structure includes a lower shaft portion and an intermediate shaft portion. The handle portion is offset from the lower shaft axis by the intermediate shaft portion so that the golfer's view line is not obstructed by the handle portion or the golfer's hands during the putting stroke.

U.S. Pat. No. 4,625,965 to Mullins, entitled Golf Putter, describes a putter which has the upper part of the grip bent rearwardly and anteriorly with respect to the putter face. This arrangement is said to produce a locked putting grip for promoting a smooth and consistent putting stroke.

U.S. Pat. No. 4,621,816 to Leek, entitled Side Stroking Golf Putter, describes a side stroking putter in which the shank portion of the shaft is connected with the putter head above one or more oppositely directed putting faces and the putter head is positioned remote from the user by a connection between the shank and the handle portions to provide the user with a completely free and unobstructed view of the putting faces of the putter head during the stroke of the putter and to provide the golfer with better control of the putter.

U.S. Pat. No. 4,269,412 to Hughes, entitled Golf Club Grip, describes a golf club grip having an outer contour shaped to permit a golfer's hands to assume a substantially normal position when addressing the ball and to promote the correct rotation of the golfer's left elbow. By allowing natural hand placement and promoting proper left hand rotation, the grip is said to reduce the tendency to slice or hook.

U.S. Pat. No. 3,663,019 to Palotsee, entitled Adjustable Golf Putter, describes a golf putter having a telescoping shaft and a swivel connection, permitting the upper portions of the shaft and the grip to be angled relative to the main portion of the shaft and the putter head. The swivel connection allows the upper portion of the shaft to pivot in a plane parallel to the ball-striking face.

U.S. Pat. No. 3,341,203 to Brill, entitled Shaft Weighted Golf Club Including Offset Shaft Portions, describes a golf club having an offset shaft, in which the offsetting portion of the shaft is weighted to provide a greater weight between the hand grip and the club head, than at the club head.

U.S. Pat. No. 3,062,549 to Duden, entitled Golf Putter, describes a golf putter which when hanging plumb from a golfer's hands will have the lower portion of the shaft in line with the golfer's eyes and with the back of the golf ball. This putter is said to put substantial overspin upon the ball due to the shape of the shaft and the face of the golf club so that a golf ball struck with this putter will follow the desired putting line.

U. S. Patent No. 2,212,651 to Sanderson, entitled Golf Club Or Putter, describes a putter having a conventional head, with the shaft being bent or curved in such a way that the player, while gripping the club conventionally, may assume a stance which will bring his eyes in direct line with the ball and hole.

U.S. Pat. No. 2,132,219 to Pirie, entitled Golf Club, describes a golf club having a head and a shaft, the shaft being connected to a hand-hold member, and the shaft and the hand-hold member being connected so as to permit relative movement between the two.

U.S. Pat. No. 1,979,174 to Robertson, entitled Handle of Golf Clubs and The Like, describes an off-set of the upper hand-grip portion of a handle, directly in the line of intended flight of the ball. The off-set of the upper hand grip is effected by inclining about five inches of the top of the handle directly forwardly at an angle to the remainder of the handle from about one in four to one in six.

U.S. Pat. No. 1,201,728 to Henry et al., entitled Golf Club, describes a golf club in which the grip or handle thereof may be readily adjusted to meet the needs of the user. The grip can be bent at an angle of approximately 45 degrees so as to give the greatest bending facility not only back to the perpendicular but to an angle of 90 degrees according to the requirements of the individual player.

U.S. Design Pat. Nos. 326,302; 256,824; 255,592; 204,002; and 202,504, each describe golf club designs which include modifications to the conventional straight shaft design. The disclosures of these patents are also hereby incorporated herein by reference.

SUMMARY OF THE INVENTION

The present invention relates to the field of golf, and particularly to an offset grip shaft for use with the putter. The offset in the grip portion of the shaft is formed to be substantially parallel to the face of the putter head, but the direction in which the top of the shaft can be bent may be either forward (i.e., bent away from the player) or backward (i.e., bent toward the player) and such an offset may be used with a variety of putter heads, i.e., mallets, offsets, tear drops, blade, and the like. One particularly preferred form of this putter will be commercialized under the trademark HOLN-1.™

The present invention is thus directed to a new golf club shaft and to golf clubs employing the shaft of this invention. Preferably the club on which this shaft is used is a putter, but other clubs can also benefit from this invention. The shaft of the present invention has an offset bend in it at the top of the shaft, ideally at about the midpoint of the grip section of the shaft. Some variation in the positioning of the offset is acceptable, so long as the two sides of the offset will accommodate a golfer's right hand and left hand on opposite sides of the offset bend. Such an offset allows the golfer's hands to become perfectly aligned, one under the other, whether the golfer uses the conventional reverse overlap or the somewhat new and stylish cross-handed grip. The shaft of the present putter is even functional for the golfer who putts holding the club with only one hand.

It has been found that with a golfer's hands aligned in the manner promoted by the shaft of the present putter, the club is swung in more of an ideal pendulum stroke—the stroke design recognized as being needed to keep the putt on line. By promoting a pendulum stroke, the shaft of the present invention eliminates the breaking down of the left wrist (i.e., right handed pushing) which typically forces the putt to be pulled, by eliminating the wristing action commonly seen in the putting stroke, thereby providing a much more consistent putting ability.

DETAILED DESCRIPTION OF THE PREFERRED EMBODIMENTS

Figure 1:
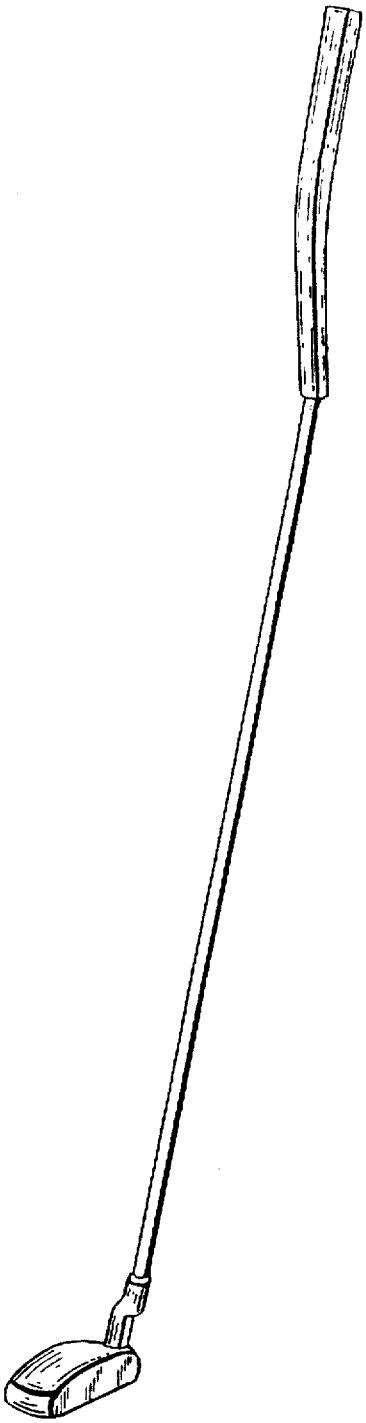
FIG. 1 is an isometric view of a golf putter including an offset grip shaft according to the present invention.
Figure 2:
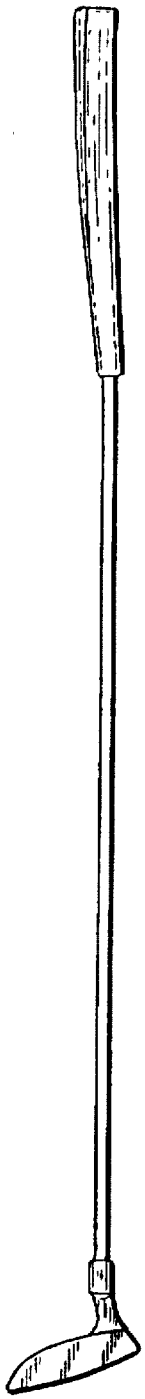
FIG. 2 is a front view of the golf putter of FIG. 1, with the striking face of the putter facing out.
Figure 3:
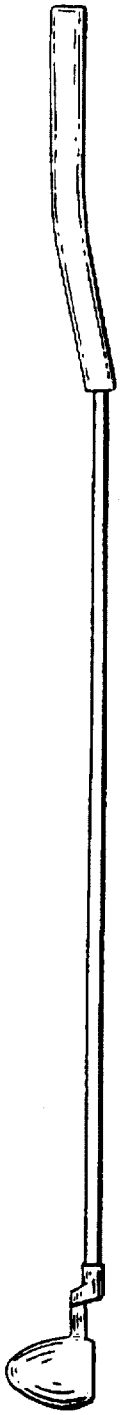
FIG. 3 is side view of a golf putter of FIG. 1, rotated 90° from the view shown in FIG. 2, i.e., with the striking face of the putter facing to the right.
Figure 4:
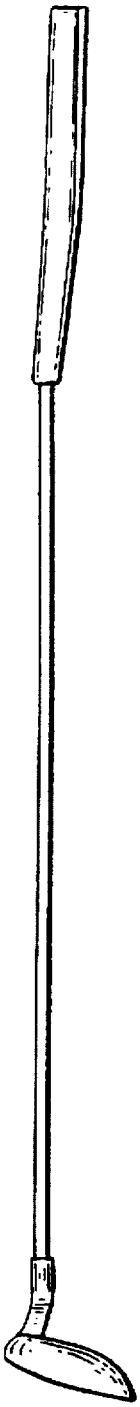
FIG. 4 is back view of a golf putter of FIG. 1.
Figure 5:
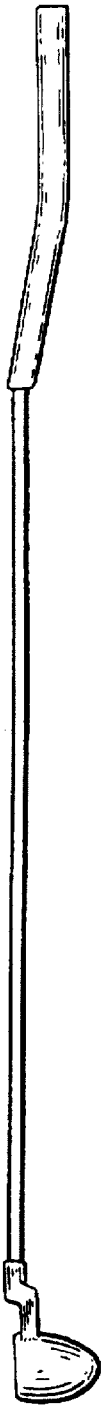
FIG. 5 is a back view of a golf putter of FIG. 1, rotated 90° from the view shown in FIG. 4, i.e., with the striking face of the putter facing to the back of the page.

As shown in FIGS. 1–5, the present invention comprises a golf shaft 10 provided with an offset 12, located at about the midpoint of the grip area 14 of the golf shaft. At the opposite end of the shaft 10 is the putter head 16, in which the striking face 18 of the putter head 16 is positioned substantially parallel to the direction of the offset 12 at the other end of the shaft 10.

The illustrated embodiment was made by heating the a standard steel putter shaft at about the midpoint of the grip end (the grip being first removed) and putting two (2) one-quarter inch (¼") bends in the shaft with a pipe bender, in a direction parallel to the striking face of the putter head, creating an approximately one-half inch (½") offset therein. Steel shafts, club heads and grips are all commercially available materials, and methods of assembling these components into a putter or other golf club are well known.

While the illustrated embodiment shows the top section of the shaft facing away from the body of a right-handed golfer, the offset can be formed in the other direction, i.e., with the top being bent toward the body of a right handed golfer. This can be accomplished either by forming the offset in the opposite direction (in the case of a shaft mounted to a putter blade) or by turning the shaft 180° at the blade end, so that the offset is facing the golfer. Should a particular golfer prefer to have the offset face in some other position, the shaft may be rotated by heating the connection between the shaft and the putter blade, and fixing the shaft in any preferred location using conventional methods (e.g., epoxy glue).

While in its preferred embodiment the offset shaft is used for a putter, it is envisioned that the same type of offset can be employed in regular irons as well, and such a modified shaft would be a great training aid. The putter design of the present invention can be used both as a functional putter (i.e., on the golf course) in addition to being an exceptional training aid.

The shaft design of this invention was developed after deliberating about different hand positions while putting with conventional straight shafted putters. The modification of the shaft was formed by heating a standard putter shaft at about the middle of the grip end, and putting two (2) approximately one-quarter inch (¼") bends therein, thereby forming an offset of approximately one-half inch (½") in the middle of the handle area of the grip. With the offset shaft of the present invention, a golfer will always have one hand more in line with the other, creating more of a true pendulum stroke, thus eliminating the "wristing" action out of the putt or the breakdown of the left wrist during the stroke, both of which cause the putter head to go ahead of the hands, usually causing a pulled putt. This shaft design modification will work for both a conventional putting grip and with the so-called cross handed grip. It also works with the unconventional one handed putting style, because the top of the offset handle naturally lays against the forearm in such a stroke, providing exceptional stability.

Some of the many advantages obtained by use of the shaft design of the present invention, include the following; (1) automatic and "natural" hand placement around the offset putter handle; (2) promoting a steady and natural pendulum swing (preferred for putting); (3) thereby promoting more consistent putting; (4) which leads to lower golf scores; (5) confidence leads to even greater accuracy in putting (e.g., long putts become "makeable"); (6) short putts are not pulled; (7) the putter using the shaft of this invention is both a training aid and (8) a functional putter; and finally the shaft design of this invention (9) can be used with other clubs, particularly irons, e.g., for training, due to (10) its decrease of wrist breakdown.

The present invention has been described in detail, including the preferred embodiments thereof. However, it will be appreciated that those skilled in the art, upon consideration of the present disclosure, may make modification and/or improvements on this invention and still be within the scope and spirit of this invention as set forth in the following claims.

What is claimed is:

1. A golf club having a shaft with a grip portion at one end and a putter head at an opposite end;

wherein the grip portion has an offset bend therein, wherein an upper side of the offset bend accommodates one hand of a user while a lower side of the offset bend accommodates the other hand of a user, said lower side of said offset bend being positioned behind a plane containing said striking face of said head, and said upper side of said offset being substantially parallel to the plane of the striking face of said head.

2. The grip portion of claim 1, wherein said offset bend is formed at approximately the midpoint of said grip portion.

3. The grip portion of claim 1, wherein said offset bend is approximately a one-half inch offset.

4. A method of forming a grip portion of a shaft of a golf club, said method including the steps of:

heating a metal golf club shaft at approximately a middle portion of a grip portion thereof; and placing two approximately ¼ inch bends in said heated middle portion, thus creating an approximately ½ inch offset bend therein, said offset bend having an upper side and a lower side, the lower side being positioned behind a plane containing a striking face of a golf club head attached to the shaft, wherein the club head striking face literally faces the intended striking direction said upper side being positioned substantially parallel to the plane of the striking face.

5. The method of claim 4, wherein said offset bend is switched between two positions of being bent either towards or away from a right-handed user by performing the additional step of turning the shaft 180° degrees at a blade end thereof.

6. The method of claim 4, wherein said offset bend is bent in such a way that one side of the offset bend will accommodate one hand of a user while the other side of the offset bend will accommodate the other hand of a user.

* * * * *